United States Patent [19]

Enjo et al.

[11] 4,232,525

[45] Nov. 11, 1980

[54] WORKING FLUID FOR RANKINE CYCLE

[75] Inventors: Naonori Enjo, Suita; Hideki Aomi, Osaka, both of Japan

[73] Assignee: Daikin Kogyo Co. Ltd., Osaka, Japan

[21] Appl. No.: 5,801

[22] Filed: Jan. 23, 1979

[30] Foreign Application Priority Data

Feb. 7, 1978 [JP] Japan ..... 53-13123

[51] Int. Cl.[3] ..... F01K 25/00

[52] U.S. Cl. ..... 60/671; 60/651; 252/67

[58] Field of Search ..... 60/651, 671; 252/67

[56] References Cited

U.S. PATENT DOCUMENTS

| | | | |
|---|---|---|---|
| 3,722,211 | 3/1973 | Conner et al. | 60/671 X |
| 3,940,939 | 3/1976 | Davis | 60/671 X |

*Primary Examiner*—Allen M. Ostrager
*Assistant Examiner*—Stephen F. Husar
*Attorney, Agent, or Firm*—Armstrong, Nikaido, Marmelstein & Kubovcik

[57] ABSTRACT

A Rankine cycle working fluid containing a mixture of 2,2,3,3-tetrafluoropropanol and water, which is low toxic, incombustible, nonexplosive, noncorrosive and stable, and also has a high critical temperature and forms azeotropic-like composition. It is suited for use in a Rankine cycle using heat source of low temperature.

3 Claims, 2 Drawing Figures

WORKING FLUID FOR RANKINE CYCLE

BACKGROUND OF THE INVENTION

The present invention relates to a novel working fluid for use in a Rankine cycle, and more particularly to a working fluid containing a mixture of 2,2,3,3-tetrafluoropropanol and water suited for use in a Rankine cycle designed to utilize a heat source of low temperature.

Water is the most general working fluid having been employed in Rankine cycle systems, and a steam engine which is a typical Rankine cycle system has been put to practical use from old times. However, the water working fluid has the defects that the range of its use is limited and equipments, particularly equipments using a heat source of low temperature, become large so that the efficiency is lowered, because the freezing point of water is high and its vapor density is low.

In order to improve the defects of the water working fluid, various organic working fluids have been proposed. However, most of them are combustible or corrosive, and a satisfactory working fluid has not been yet obtained. Japanese Patent Examined Publication No. 28271/1976 discloses a mixture of trifluoroethanol and water employed as a working fluid for a Rankine cycle power system. This working fluid is not combustible and not corrosive, but it cannot form an azeotropic-like composition as in the present invention stated after and has not a sufficiently high critical temperature. Therefore, the trifluoroethanol-water working fluid is still unsatisfactory for the Rankine cycle use, and an excellent working fluid for a Rankine cycle is strongly desired.

SUMMARY OF THE INVENTION

The present invention provides a working fluid comprising a mixture of 2,2,3,3-tetrafluoropropanol (hereinafter referred to as "TFP") and water for a Rankine cycle in which the working fluid is vaporized, the vapor is expanded to give a mechanical energy and the vapor is then condensed.

DETAILED DESCRIPTION

Figure 1:
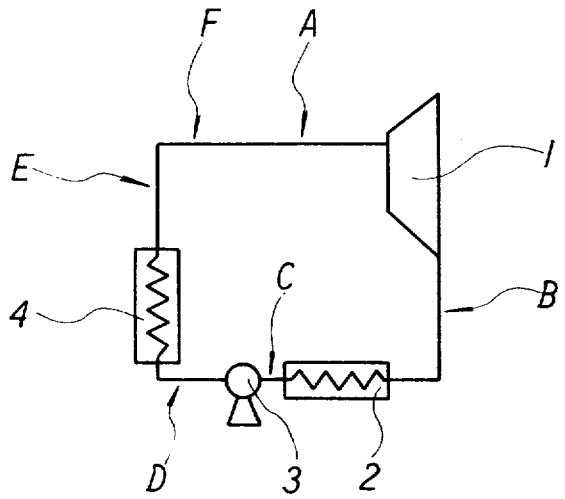
FIG. 1 is a flow diagram showing a typical Rankine cycle.
Figure 2:
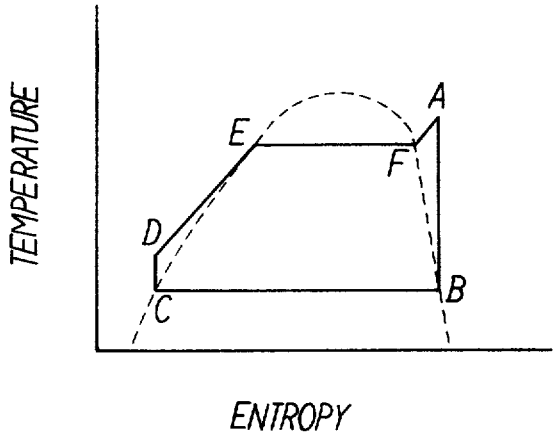
FIG. 2 is a schematic temperature-entropy diagram for a TFP-water working fluid of the present invention employed in a Rankine cycle.

Referring now to the drawings, FIG. 1 illustrates a flow diagram of Rankine cycle for converting heat energy to mechanical energy and FIG. 2 illustrates a schematic temperature-entropy diagram for a TFP-water fluid, wherein the reference characters in FIG. 1 correspond to points shown by the reference characters in FIG. 2.

A working fluid is heated by a vapor generator 4 and is vaporized to give the vapor of high temperature and high pressure. This is shown by the (D)-(E)-(F)-(A) change in FIG. 2. That is to say, the temperature of the liquid working fluid rises by heating, and after boiling starts and the whole is vaporized, the vapor is further heated to the superheat state. The superheated working fluid vapor is then fed into an expansion device 1 where adiabatic expansion of the vapor is conducted. As a result, the temperature and pressure lower and the work between (A) and (B) shown in FIG. 2 is made. The working fluid whose temperature and pressure have become low by the work in the expansion device 1 is then fed into a condenser 2 and is liquefied as shown by (B)-(C) in FIG. 2. The liquefied working fluid is fed into a pump 3 by which the pressure of the working fluid is raised, and the compressed working fluid is fed back into the vapor generator 4.

Rotating or reciprocating displacement expansion devices and turbine expansion devices may be usable as the expansion device 1 employed in a Rankine cycle. Boilers of the same type as those generally employed in the steam generation may be usable as the vapor generator 4. As the condenser 2, there may be employed those generally employed in refrigerating apparatuses. Pressure liquid feed pumps for organic solvents generally employed in chemical plants may be usable as the pump 3.

The features of the Rankine cycle working fluid containing the TFP-water mixture of the present invention are as follows:

(1) The toxicity of TFP is very low. The oral lethal dose of TFP is from 2 to 3 g./kg., and no special care is required upon the use.

(2) In general, use of combustible or explosive working fluids is limited to a narrow range. TFP does not burn at ordinary temperature, and the mixture of TFP and water does not burn nor explode at any states. Therefore, the working fluid of the present invention has a wide range of use.

(3) One of particularly important characteristics required in a Rankine cycle working fluid is the thermal stability. TFP does not decompose at ordinary temperature and is stable even at a high temperature region of a Rankine cycle. Of course, TFP admixed with water does not react with water nor decompose at ordinary temperature and even at a high temperature region of a Rankine cycle, as in the case of TFP alone. Thus the mixture of TFP and water is very stable.

(4) Metals are generally employed as the materials for a Rankine cycle power system. TFP does not corrosively attack the metals, especially iron widely employed in a Rankine cycle power system. Also as to the TFP-water mixture, there is seen no corrosion interfering with the operation of a Rankine cycle power system for a long term. Therefore, the TFP-water working fluid of the invention can be employed for a long term without accumulating corrosion products therein which interfere with the operation of a Rankine cycle power system.

(5) The critical temperature of TFP is relatively high, i.e. 285° C., and the TFP-water working fluid of the invention has a higher critical temperature than TFP alone as shown in the following Table 1. Therefore, the working fluid of the invention can be worked at a sufficiently lower temperature than the critical temperature, and accordingly has excellent thermodynamic properties desirable for use in a Rankine cycle.

TABLE 1

Critical Temperature of TFP-Water Mixture

| Mole % of water | Weight % of water | Critical temperature (°C.) |
|---|---|---|
| 0 | 0 | 285 |
| 25 | 4.3 | 312 |
| 50 | 12.0 | 329 |

TABLE 1-continued

| Critical Temperature of TFP-Water Mixture | | |
|---|---|---|
| Mole % of water | Weight % of water | Critical temperature (°C.) |
| 74 | 27.5 | 351 |

It is the most desirable thermodynamic property for a Rankine cycle working fluid that the saturated vapor line of the working fluid as shown by the dotted line in FIG. 2 is the isentropic change. In a Rankine cycle using a working fluid having such a property, a heat source can be efficiently utilized.

The closer to the critical temperature, the more closely the thermodynamic properties of a working fluid are akin to the properties of a compressed gas, and above the critical temperature the working fluid becomes the compressed gas. Therefore, in a Rankine cycle which undergoes the condensation-vaporization cycle, it is necessary from a viewpoint of efficiency that the work is conducted at a temperature of as lower as possible than the critical temperature of the working fluid. Accordingly, a working fluid having a higher critical temperature is more preferred for use in a Rankine cycle.

Also, the latent heat of vaporization L of a substance having a critical temperature Tc at a temperature T is shown by the following equation;

$$L = C(Tc - T)^n$$

wherein C and n are respectively a constant inherent in a substance. For instance, in case that substances have similar chemical structures to each other, the latent heat of vaporization L at a temperature T depends on only the critical temperature Tc, since the constants C and n for both substances are approximately the same. Accordingly, the substance having a higher critical temperature has a higher latent heat of vaporization than that of the substance having a lower critical temperature. Therefore, for instance, in case of comparing TFP with trifluoroethanol having a similar chemical structure thereto disclosed in Japanese Patent Examined Publication No. 28271/1976, since TFP has a higher critical temperature than trifluoroethanol having a critical temperature of about 227° C., thus has a higher latent heat of vaporization than trifluoroethanol, the entropy change for TFP, as shown by (E)-(F) in FIG. 2, caused by the vaporization which occupies the greater part of the heat transfer in a Rankine cycle is larger than that for trifluoroethanol. Therefore, TFP can provide a more preferable working fluid having a good cycle efficiency.

Also, the critical temperature of a mixture of 96.92% by weight of trifluoroethanol and 3.08% by weight of water having the best cycle efficiency among the trifluoroethanol-water mixtures of the Publication is about 241° C., and is lower than that of the TFP-water mixture of the invention. In this respect the TFP-water mixture of the invention is also superior to the trifluoroethanol-water mixture as a Rankine cycle working fluid.

(6) The most significant feature among the thermodynamic properties of TFP is that it forms the azeotropic-like composition with water. By applying this property, heat sources of low temperature can be utilized and the working fluid suited for use in a Rankine cycle whose high temperature region is about 200° C., can be obtained.

A mixture of 72.5% by weight of TFP and 27.5% by weight of water forms the azeotropic composition, the boiling temperature of which is 92.5° C. The vapor pressure of the azeotropic composition compared with the vapor pressure of water is shown in the following Table 2.

TABLE 2

| | Vapor Pressure of TFP-Water Azeotropic Composition and Water (atm.) | | | |
|---|---|---|---|---|
| | 40° C. | 90° C. | 140° C. | 190° C. |
| TFP-water azeotropic mixture | 0.09 | 0.91 | 4.65 | 15.13 |
| Water | 0.07 | 0.69 | 3.57 | 12.39 |

An expansion device is one of the important devices employed in a Rankine cycle, and it is important to make the device small from a viewpoint of design and cost. The size of the expansion device having such an important factor is determined by the vapor volume per unit output at the time when the working fluid has been exhausted from the device. That is to say, the larger the entropy difference of a working fluid between the inlet and outlet of an expansion device on the basis of the vapor volume at the time of exhaust from the device, the better working fluid, because a larger work load (output of power) can be obtained by a small expansion device. It is known that the capacity of a working fluid is approximately proportioned to its vapor pressure. Therefore, the higher the vapor pressure of a working fluid at an outlet of an expansion device is, the smaller an expansion device can be made.

As shown in Table 2, the vapor pressure of the TFP-water azeotropic composition at 90° C. is about 1.3 times that of water, and in proportion to this it is possible to make the size of an expansion device small. Thus, the superiority of the TFP-water azeotropic composition to water in the use as a working fluid is very large.

The TFP-water mixture of the present invention forms the azeotropic composition, when the mixture consists of 72.5% by weight of TFP and 27.5% by weight of water, and also the TFP-water mixture forms an azeotropic-like composition, when the mixture consists of 93% to 53% by weight of TFP and 7% to 47% by weight of water. Therefore, since the boiling temperature of the composition is lower, it is able to utilize a hot source of lower temperature and also various merits can be produced on the basis thereof. On the other hand, trifluoroethanol disclosed in Japanese Patent Examined Publication No. 28271/1976 cannot form the azeotropic composition with water and, therefore, merits based on the azeotropy as in the present invention cannot be produced. Differences between an azeotropic-like composition and a non-azeotropic composition in the use as a Rankine cycle working fluid are summarized in the following Table 3.

TABLE 3

| | Azeotropic-like Composition | Non-azeotropic Composition |
|---|---|---|
| Operation pressure | Pressure is stable, since liquid composition in vapor generator and that in condenser are the same. | Pressure in condenser is higher than that in vapor generator, since liquid in the former contains a |

TABLE 3-continued

| | Azeotropic-like Composition | Non-azeotropic Composition |
|---|---|---|
| | | larger amount of low boiling component than liquid in the latter. |
| State of working fluid in expansion device | No liquid droplet due to abnormal condensation is produced, because the composition is unexchangeable. | High boiling component condenses in preference to low boiling component to produce liquid droplets which damage turbine of expansion device. |
| Working fluid composition in condenser | Composition is uniform all over, and no problem is caused. | Composition is not uniform because of condensation of high boiling component in preference to low boiling component and, therefore, thermal conductivity changes and heat exchange is not uniformly conducted. |
| When working fluid leaks | Composition does not change, and total power output of complete machine is always kept constant. | Composition changes because liquid phase composition differs from vapor phase composition, and as a result, thermodynamic properties change and total power output of complete machine is not kept constant |

In case of employing a turbine expansion device, it is known that a working fluid having a larger vapor density, in other words, a heavier vapor is superior to a lighter vapor, since the former produces a larger output when a turbine of the same size is employed. The molecular weight of TFP is about 132 and is very large as compared with the molecular weight of water (about 18). The vapor density of the TFP-water azeotropic composition at 90° C. is about 10 times that of steam and, therefore, the superiority of the TFP-water mixture to water in the use as a working fluid is very large, when a turbine expansion device is employed.

TFP-water mixture of the present invention can be employed as a Rankine cycle working fluid without any additives, but it may be employed in combination with appropriate hydrocarbons or synthetic lubricating oils.

What we claim is:

1. A working fluid for a Rankine cycle in which the working fluid is vaporized, the vapor is expanded to give a mechanical energy and the vapor is then condensed, which comprises a mixture of 2,2,3,3-tetrafluoropropanol and water.

2. The working fluid of claim 1, wherein said mixture is the azeotropic-like composition consisting of 93% to 53% by weight of 2,2,3,3-tetrafluoropropanol and 7% to 47% by weight of water.

3. The working fluid of claim 1, wherein said mixture is the azeotropic composition consisting of 72.5% by weight of 2,2,3,3-tetrafluoropropanol and 27.5% by weight of water.

* * * * *